US007004086B2

(12) United States Patent
Morrison et al.

(10) Patent No.: US 7,004,086 B2
(45) Date of Patent: Feb. 28, 2006

(54) INJECTION OF OVERFIRE AIR THROUGH THE UPPER FURNACE ARCH FOR PENETRATION AND MIXING WITH FLUE GAS

(75) Inventors: Donald K. Morrison, Clinton, OH (US); Thomas Alfred Laursen, Canton, OH (US); Paul Gregory Stonkus, Norton, OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/868,847

(22) Filed: Jun. 17, 2004

(65) Prior Publication Data

US 2005/0279262 A1 Dec. 22, 2005

(51) Int. Cl.
*F23B 5/00* (2006.01)

(52) U.S. Cl. ..... 110/210; 110/214

(58) Field of Classification Search ..... 110/210, 110/214, 348, 3.45
See application file for complete search history.

(56) References Cited

U.S. PATENT DOCUMENTS 5,771,817 A * 6/1998 Olausson et al. ..... 110/238
5,803,020 A * 9/1998 Palmgren ..... 122/7 R

* cited by examiner

*Primary Examiner*—Kenneth Rinehart
(74) *Attorney, Agent, or Firm*—Nixon & Vanderhye P.C.

(57) ABSTRACT

The boiler nose or arch of a furnace projects into the upwardly flowing flue gas to form a restricted passage. Overfire air is introduced into the cavity or plenum of the boiler nose and flows to injection ports along the inclined surface of the boiler nose to provide overfire air for penetration into and mixing with the flue gases in the restricted flue gas passage.

11 Claims, 5 Drawing Sheets

INJECTION OF OVERFIRE AIR THROUGH THE UPPER FURNACE ARCH FOR PENETRATION AND MIXING WITH FLUE GAS

BACKGROUND OF THE INVENTION

The present invention relates to boilers, e.g., steam boilers having an upper furnace arch forming a restriction in the flue gas passage and particularly relates to injection of overfire air through the upper furnace arch for penetration and mixing with the boiler flue gas.

A typical industrial furnace, whether gas or fossil fired and hereafter referred to as a boiler, typically includes a lower combustion zone and a generally vertically extending flue gas passage. An upper furnace wall in part defining the flue gas passage conventionally includes a furnace arch, hereafter referred to as a boiler nose or nose, for deflecting the flue gas to facilitate a downstream turning of the flow of flue gas for horizontal flow across additional heating surfaces e.g., a boiler convection pass. The flue gas then typically turns vertically downwardly to flow across further horizontally arranged tubes before flowing to the stack. The boiler nose also protects the bottom of the superheater from radiant shine.

Overfire air is typically injected into the flue gas at a location in the flue gas passage downstream of the combustion zone. Overfire air is conventionally but not necessarily, combustion air which is preheated and pressurized. The combustion air provided the combustion zone is typically reduced to provide the overfire air. The reduced combustion air reduces the flame temperature in the combustion zone and hence NOx formation. However, the reduced temperature creates excessive unburned hydrocarbons. The overfire air, introduced above the primary combustion zone, completes combustion of the unburned hydrocarbons which are then converted to carbon dioxide and water.

In conventional boilers, the overfire air is introduced into the flue passage through injection ports in the front or side walls or both of the boiler. Because of the depth of the boiler and the flue passage, adequate penetration and mixing of the overfire air injected through the front or side wall locations with the flue gases would require substantially higher injection pressures and typically in excess of pressures available for delivery from existing forced draft fans. One solution to the problem of inadequate mixing and jet penetration of the overfire air into the combustion (flue) gases has been to provide boost air fans which in turn require extensive high pressure ducting. It will be appreciated that the overfire air in certain boilers may be required to penetrate a depth of about 40 feet in order to reach the rear wall of the furnace that contains the bulk of the upwardly flowing gases. Using the rear wall as injection locations for the overfire air has not been practical since the rear wall is integral with the convection backpass of the boiler substantially down to a point adjacent the combustion zone. The commonality of the rear wall with the flue gas passage and the boiler convection backpass precludes overfire air injection ports at that location. Accordingly, there is a need for an overfire air injection system which will optimize flue gas penetration by the overfire air without the need for boost air fans otherwise required to generate the elevated static pressure necessary to penetrate the depth of the furnace with overfire air flow streams.

BACKGROUND OF THE INVENTION

In accordance with a preferred aspect of the present invention, the upper furnace arch, i.e., the boiler nose, is employed as a plenum from which overfire air is injected into the combustion gases. With this configuration, the overfire air need penetrate only a short distance into the combustion gases to provide optimum mixing performance without the need for higher pressure boost air fans or higher pressure overfire air. Particularly, the boiler nose itself may serve as a plenum in which overfire air is received, preferably through openings in one or both of the side walls for flow through ports in the boiler nose and consequent injection into the combustion gases. Preferably, however, the overfire air is supplied to ducts extending from one or both of the side walls of the furnace into the boiler nose. A plurality of port ducts communicate between the laterally extending duct(s) in the boiler nose and ports formed along the one or more inclined surfaces of the boiler nose for injection into the combustion gases. That is, the boiler nose is generally comprised of a vertically upwardly inclined lower surface directed toward the restriction in the flue gas passage formed by the nose and the opposite boiler wall and an upper inclined surface directed away from the restriction in the flue gas passage. The overfire air injection ports may be provided in the lower or upper or both inclined surfaces of the boiler nose.

In a further embodiment, the overfire air may be supplied to the boiler nose in a pair of discrete ducts respectively extending into the boiler nose from opposite side walls of the furnace. Each of the laterally extending ducts has a plurality of port ducts communicating with the ports in the inclined wall of the boiler nose. It will also be appreciated that two or more ducts may be provided in the boiler nose extending from the respective side walls of the boiler. In that configuration, the supply of overfire air can be regulated into different zones of the combustion gases. In these various embodiments, it will be appreciated that the overfire air is supplied from injection ports in the boiler nose without the need for higher pressure boost fans or any reconfiguration of the rear wall of the furnace serving as a common wall between the furnace and the convection backpass. These embodiments also afford injection of the overfire air directly into the portion of the stratified combustion gas flow which is skewed to the rear half of the furnace.

In a preferred aspect of the present invention, there is provided a boiler comprising: a primary combustion zone having a downstream passage for flowing flue gases generated during combustion; and a boiler nose forming with walls of the boiler a restriction in the downstream flue gas passage, the boiler nose having a plurality of ports for feeding overfire air into the flue gases flowing along the downstream passage.

In a further preferred aspect of the present invention, there is provided a boiler comprising: a combustion zone; a boiler enclosure having side walls, a plurality of generally vertically extending water tubes forming at least portions of the side walls and a passage downstream of the combustion zone for flowing flue gas generated in the combustion zone; and a boiler nose formed at least in part by the water tubes and projecting toward an opposite wall of the boiler to form a restriction in the downstream flue passage, the boiler nose defining a generally longitudinally extending cavity substantially between a pair of boiler side walls, a duct extending through at least one of the pair of boiler side walls and into the cavity, and a plurality of ports spaced one from the other along the nose and in communication with the duct for injecting overfire air supplied to the duct into the downstream flue gas passage.

DETAILED DESCRIPTION OF THE INVENTION

Figure 1:
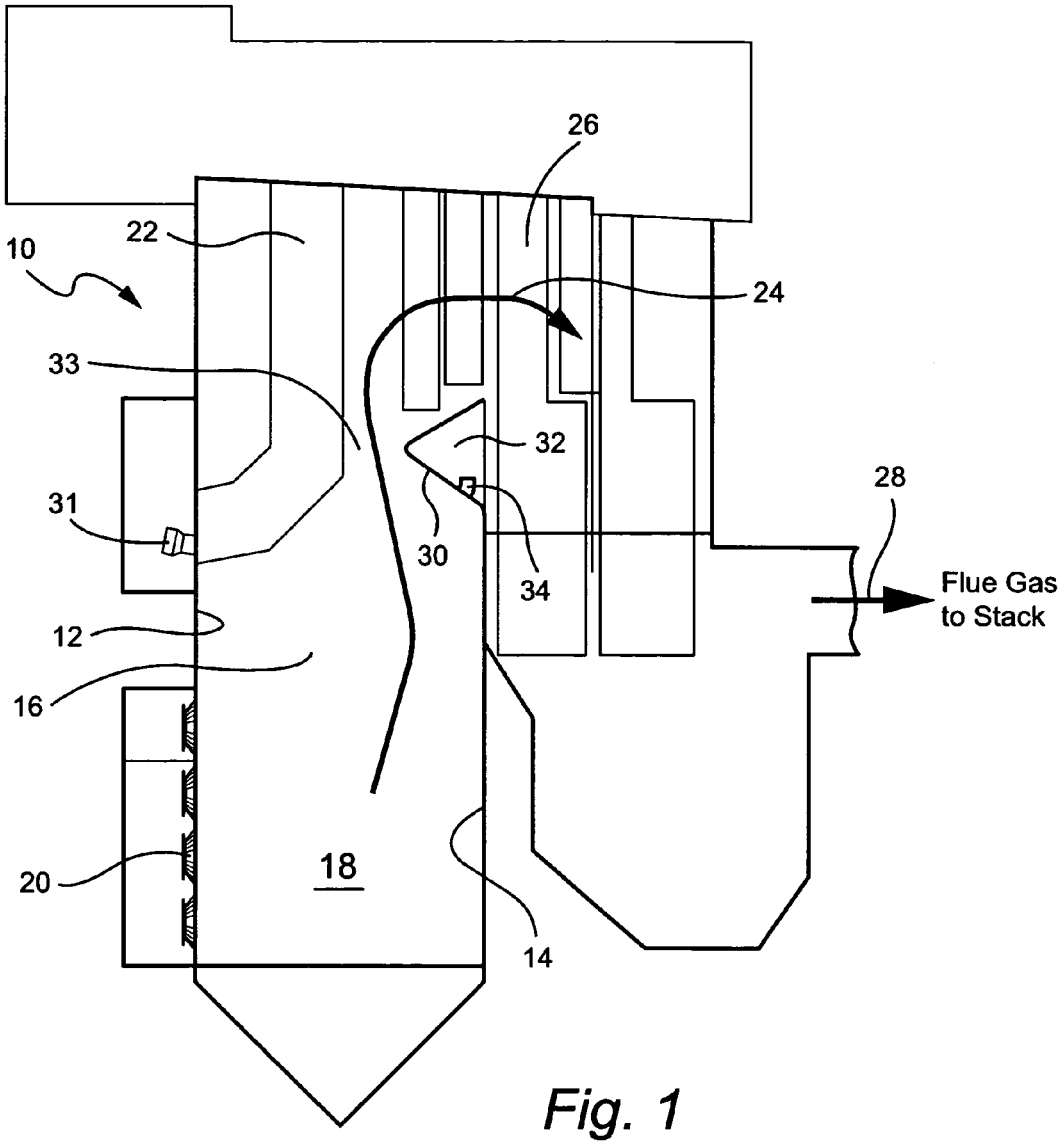
FIG. 1 is a schematic illustration of a boiler with overfire air injection from the boiler nose in accordance with a preferred aspect of the present invention.

Referring now to FIG. 1, there is illustrated a boiler generally designated 10 which is conventional in construction with the exception of the overfire air injection as set forth below. Thus, boiler 10 includes a front wall 12, a rear wall 14, opposite side walls 16 and a combustion zone 18. Main fuel burners 20 are illustrated for flowing fuel into the combustion zone 18. It will be appreciated that the combustion gases flow in a generally vertically upward direction towards a superposed superheater. The flue gases pass boiler radiant tubes 22 and are deflected in a generally horizontal direction as indicated by the arrow 24 for passage through a boiler convection bypass 26. The flue gas is then diverted vertically downwardly and eventually flows to a flue gas stack indicated by the flow direction arrow 28.

Also illustrated in FIG. 1 is a furnace arch or nose 30. The boiler nose 30 is typically mounted on the rear wall 14 of the boiler and projects toward the front wall to afford a restriction in the vertical flue gas passage which facilitates the turning of the vertical flue gas flow into the horizontal direction. Conventionally, overfire air is injected into the flue gas passage through ports 31 in the front wall 12 of the burner. It will be appreciated that the overfire air injected through the front wall must be significantly pressurized in order to penetrate and mix with the flue gases flowing upwardly through the vertical flue gas passage. In certain boilers, the boiler nose may be provided on the boiler side walls opposite one another. Overfire air may also be provided in the side walls in addition to or in lieu of the front wall. In any event, the overfire air must penetrate the flue gases over a substantial lateral distance for effective mixing with the flue gas which oftentimes require the use of additional forced air fans.

In accordance with a preferred aspect of the present invention, the boiler nose 30 is used as a plenum for receiving overfire air and injecting the overfire air directly into the flue gases passing through the flue gas passage restriction 33. For example, overfire air may be supplied directly into the cavity or plenum 32 within the boiler nose 30 for flow through injection ports 34 directly into the flue gas passage. The ports 34 are arrayed in the inclined wall portion of the boiler nose 30 and spaced one from the other between the opposite side walls 16 of the boiler. While the injection ports 34 are illustrated in the lower wall surface of the boiler nose inclined upwardly toward the restriction in the passage, it will be appreciated that the injection ports 34 may be disposed in the upper inclined surface of the boiler nose extending in a direction away from the restricted passage 33.

Figure 2:
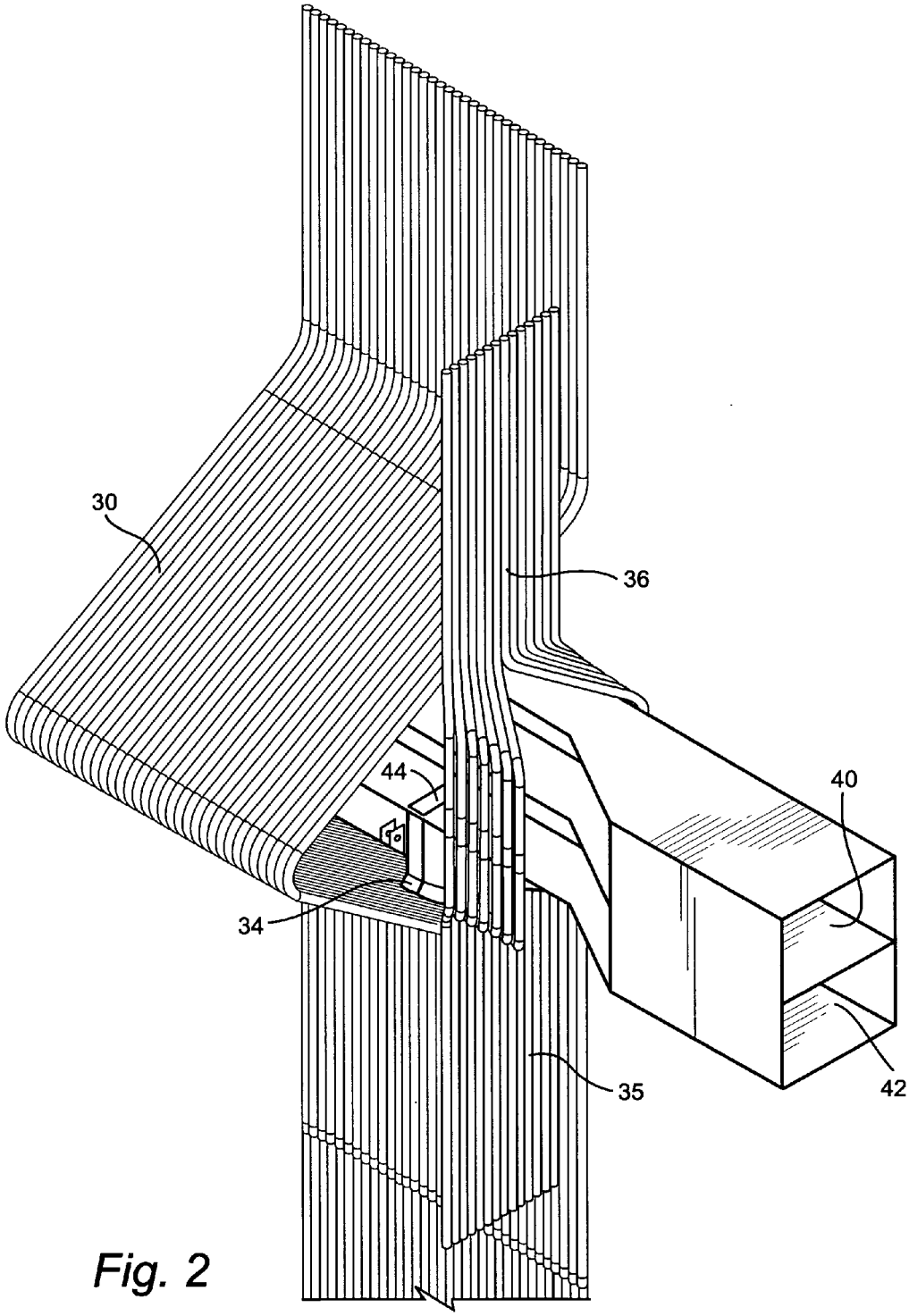
FIG. 2 is a fragmentary schematic illustration of the introduction of a duct through a side wall of the boiler for carrying overfire air into the boiler nose plenum.
Figure 3:
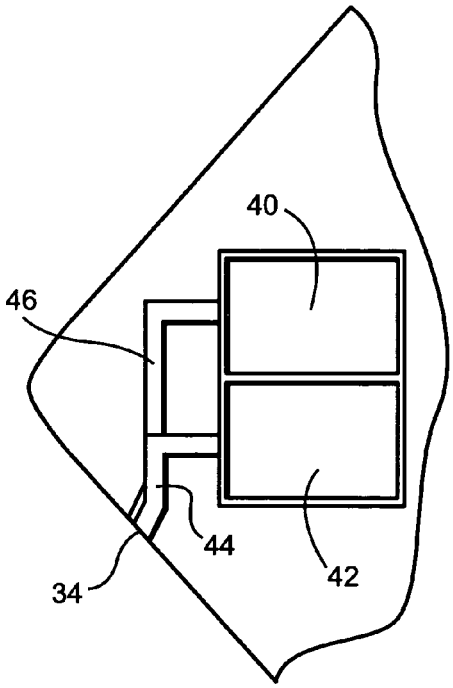
FIGS. 3, 4 and 5 are schematic illustrations of various aspects of the overfire air injection.

In a preferred embodiment of the present invention, one or more ducts are provided for introducing overfire air into the cavity or plenum within the boiler nose and additional port ducts are used to communicate the overfire air from the supply ducts to the injection ports. Particularly, and referring to FIG. 2, the overfire air supply ducts may comprise upper and lower ducts 40 and 42 respectively which penetrate one or both side walls 44 of the boiler for reception in the cavity or plenum through the boiler nose 30. In FIG. 2, the boiler side wall as well as the nose 30 are formed with water tubes 35. As illustrated, the water tubes 35 in the side wall are separated to provide an entry opening for receiving the ducts 40 and 42 into the nose 30. Port ducts, for example, the port ducts 44 and 46 (FIG. 3) respectively communicate between the upper and lower ducts 40 and 42 and injection ports 34 formed through the inclined walls of the boiler nose 30. Consequently as illustrated in FIG. 3, overfire air received in the upper duct 40 flows through the port duct 46 to injection ports 34 arrayed along the inclined surface of the boiler nose 30. Similarly, overfire air is supplied through duct 42 via port ducts 44 to injection ports 34 also arrayed along the inclined portion of the boiler nose. The various port ducts 44 and 46 may be spaced one from the other along the boiler nose to provide overfire air into selected regions or zones of the restricted flue gas passage 33. For example the lower duct 42 may supply port ducts 44 located adjacent opposite ends of the boiler nose while the duct 40 supplies port ducts 46 and injection ports spaced intermediate the injection ports supplied with overfire air from the lower duct 42. Thus the overfire air may be provided in selected zones along the boiler nose and also at different pressures, if desired.

Figure 4:
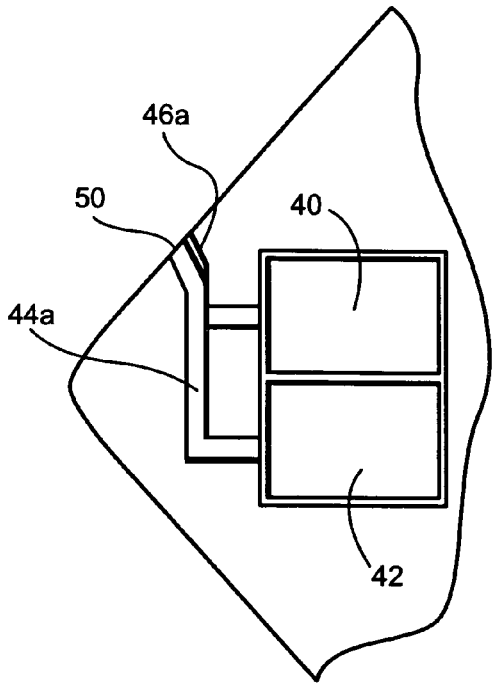
Figure 5:
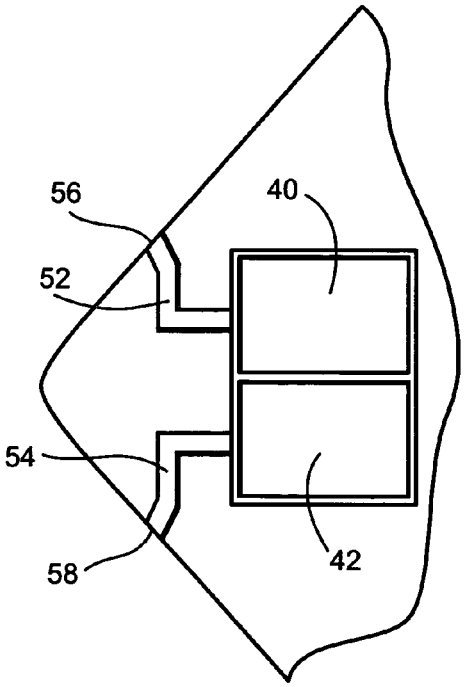

Referring to FIG. 3, it will be appreciated that the injection ports 34 are arrayed along the lower wall of the boiler nose inclined in the direction of the vertical flow of the flue gases toward the restriction in the flue gas passage 33. In FIG. 4, the upper and lower ducts 40 and 42 supply overfire air to port ducts 44*a* and 46*a* for flow to injection ports 50 arrayed along the upper inclined surface of the boiler nose, i.e. along the surface of the boiler nose which inclines in the direction of the flue gas flow and away from the restricted passage 33. In FIG. 5, the upper and lower supply ducts 40 and 42 respectively supply overfire air through port ducts 52 and 54 to injection ports 56 and 58 along the respective upper and lower inclined surfaces of the boiler nose.

Figure 6:
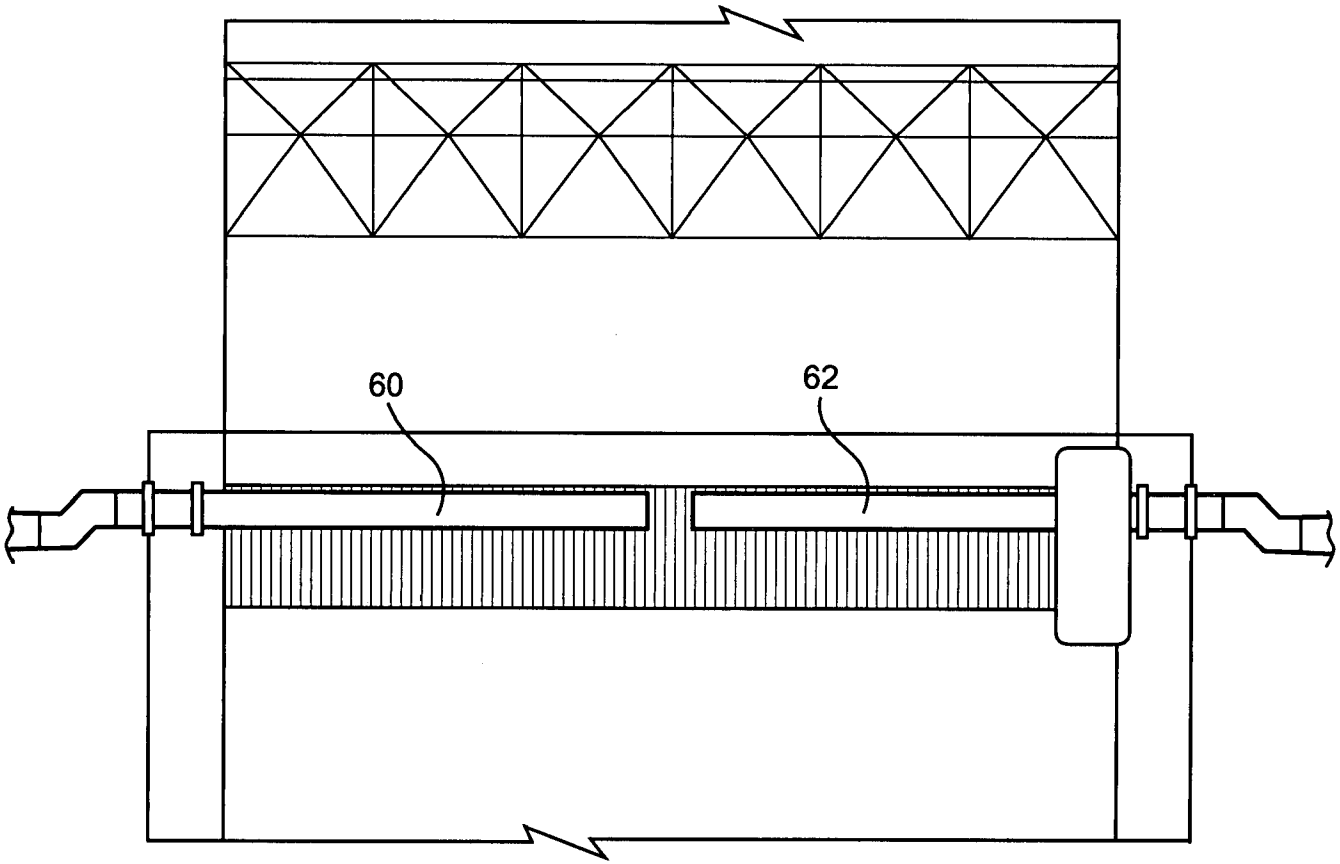
FIG. 6 is a plan view of the overfire air ducts with the upper portion of the boiler nose removed.
Figure 7:
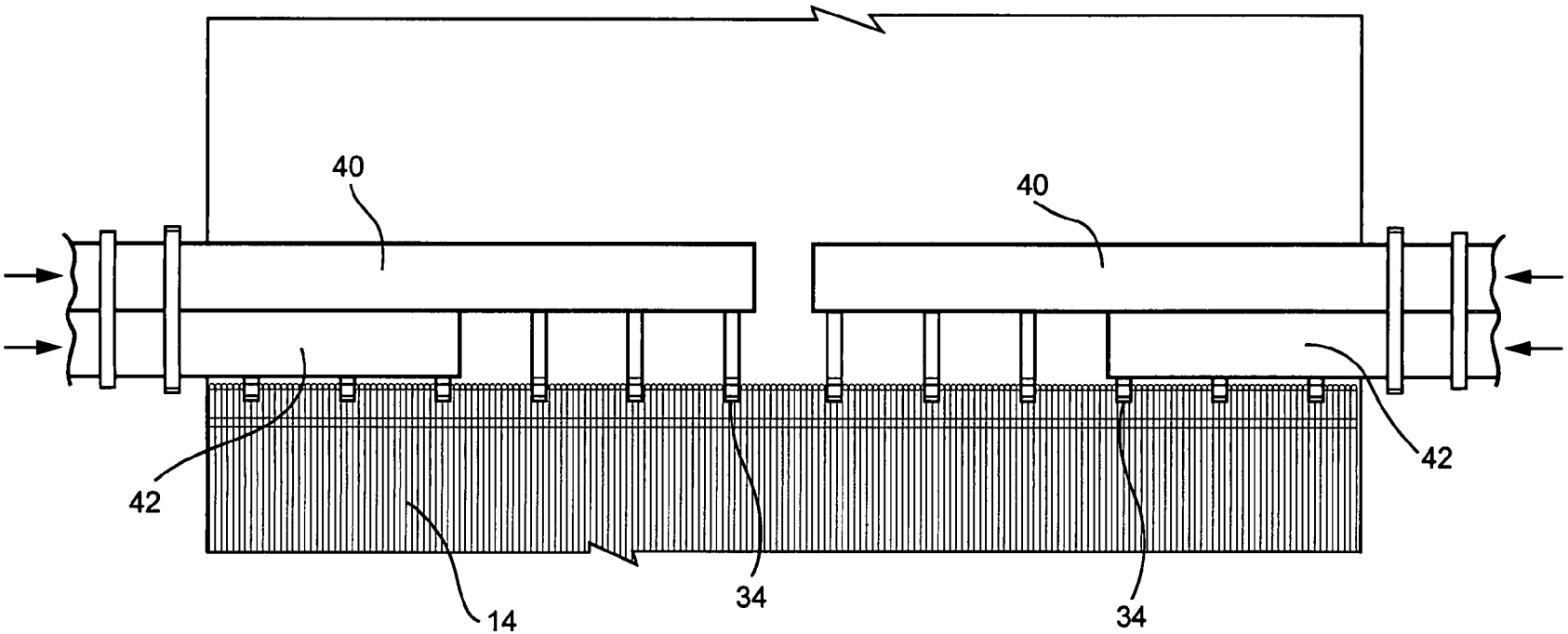
FIG. 7 is a front elevational view of the interior of the boiler nose illustrating the overfire air supply ducts and injection ports.

In FIG. 6, it will be appreciated that the overfire air supply ducts 60 and 62 may pass through the opposite side walls of the boiler terminating substantially medially of the furnace between those side walls. The ducts communicate with port ducts, not shown in this Figure, for supplying overfire air to injection ports along one or both of the inclined wall surfaces of the boiler nose similarly as described above. In FIG. 7, upper and lower overfire air supply ducts 40 and 42, respectively, penetrate the side walls of the boiler. The upper ducts 40 terminate generally medially of the boiler from the side walls while the lower ducts 42 terminate substantially medially between the termination of the upper duct and the side wall. Thus different flows at different pressures can be provided in various zones along the flue gas passage 33 of the boiler. It will also be appreciated that the plenum or cavity of the nose may serve as the duct for the overfire air without the necessity of discrete ducts within the cavity or plenum. In this case, the overfire air flows directly from the cavity or plenum through the ports in the inclined surface(s)

of the nose and into the flue gas. In all cases, the air penetration and mixing into the upwardly flowing flue gas stream is assured.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A boiler comprising:

a primary combustion zone having a downstream passage for flowing flue gases generated during combustion;

a boiler nose forming with walls of the boiler a restriction in the downstream flue gas passage, said boiler nose having a plurality of ports for feeding overfire air into the flue gases flowing along the downstream passage;

wherein said boiler walls define a generally vertically extending boiler enclosure confining the flue gas for flow in a generally upward vertical direction from said combustion zone, said boiler nose extending generally laterally across the downstream passage forming said restriction between said boiler nose and a wall of said boiler opposite said nose;

wherein said nose includes a boiler wall portion inclined relative to the generally upward vertical flow direction of the flue gas, said ports being formed in said inclined wall portion; and wherein the wall portion is inclined upwardly away from said restriction.

2. A boiler comprising:

a primary combustion zone having a downstream passage for flowing flue gases generated during combustion;

a boiler nose forming with walls of the boiler a restriction in the downstream flue gas passage, said boiler nose having a plurality of ports for feeding overfire air into the flue gases flowing along the downstream passage;

wherein said boiler walls define a generally vertically extending boiler enclosure confining the flue gas for flow in a generally upward vertical direction from said combustion zone, said boiler nose extending generally laterally across the downstream passage forming said restriction between said boiler nose and a wall of said boiler opposite said nose; and including a duct extending from a supply of overfire air under pressure and into said nose, and a plurality of port ducts extending between said overfire air supply duct and said ports for injecting overfire air into the flue gas.

3. A boiler according to claim 2 wherein said nose includes a boiler wall portion inclined relative to the generally upward vertical flow direction of the flue gas, said ports being formed in said inclined wall portion.

4. A boiler according to claim 3 wherein the wall portion is inclined upwardly toward said restriction.

5. A boiler according to claim 3 wherein the wall portion is inclined upwardly away from said restriction.

6. A boiler comprising:

a primary combustion zone having a downstream passage for flowing flue gases generated during combustion;

a boiler nose forming with walls of the boiler a restriction in the downstream flue gas passage, said boiler nose having a plurality of ports for feeding overfire air into the flue gases flowing along the downstream passage;

wherein said boiler walls define a generally vertically extending boiler enclosure confining the flue gas for flow in a generally upward vertical direction from said combustion zone, said boiler nose extending generally laterally across the downstream passage forming said restriction between said boiler nose and a wall of said boiler opposite said nose; and including a plurality of ducts extending from one or more supplies of air under pressure and into said nose for supplying the overfire air, a plurality of port ducts extending between said plurality of ducts in said nose and said ports enabling overfire air for injection from different ducts of said plurality of ducts through ports at selected locations along the nose.

7. A boiler comprising:

a primary combustion zone having a downstream passage for flowing flue gases generated during combustion;

a boiler nose forming with walls of the boiler a restriction in the downstream flue gas passage, said boiler nose having a plurality of ports for feeding overfire air into the flue gases flowing along the downstream passage;

wherein said boiler walls define a generally vertically extending boiler enclosure confining the flue gas for flow in a generally upward vertical direction from said combustion zone, said boiler nose extending generally laterally across the downstream passage forming said restriction between said boiler nose and a wall of said boiler opposite said nose; and including a plurality of ducts extending from one or more supplies of air under pressure and into said nose, a plurality of port ducts extending between said plurality of ducts in said nose and said ports, said ducts being supplied with pressurized overfire air from opposite ends of the nose.

8. A boiler comprising:

a combustion zone;

a boiler enclosure having side walls, a plurality of generally vertically extending water tubes forming at least portions of the side walls and a passage downstream of said combustion zone for flowing flue gas generated in said combustion zone;

a boiler nose formed at least in part by said water tubes and projecting toward an opposite wall of said boiler to form a restriction in the downstream flue passage, said boiler nose defining a generally longitudinally extending cavity substantially between a pair of boiler side walls, a duct extending through at least one of said pair of boiler side walls and into said cavity, and a plurality of ports spaced one from the other along said nose and in communication with said duct for injecting overfire air supplied to said duct into the downstream flue gas passage; and wherein said water tubes extend along said one of said pair of boiler side walls and are laterally diverted to provide access therethrough into said nose for said duct.

9. A boiler comprising:

a combustion zone;

a boiler enclosure having side walls, a plurality of generally vertically extending water tubes forming at least portions of the side walls and a passage downstream of said combustion zone for flowing flue gas generated in said combustion zone;

a boiler nose formed at least in part by said water tubes and protecting toward an opposite wall of said boiler to form a restriction in the downstream flue passage, said boiler nose defining a generally longitudinally extending cavity substantially between a pair of boiler side walls, a duct extending through at least one of said pair of boiler side walls and into said cavity, and a plurality of ports spaced one from the other along said nose and in communication with said duct for injecting overfire air supplied to said duct into the downstream flue gas passage; and wherein said nose includes a boiler wall portion inclined upwardly away from said restriction, said ports being formed in said inclined wall portion.

10. A boiler comprising:

a combustion zone;

a boiler enclosure having side walls, a plurality of generally vertically extending water tubes forming at least portions of the side walls and a passage downstream of said combustion zone for flowing flue gas generated in said combustion zone;

a boiler nose formed at least in part by said water tubes and projecting toward an opposite wall of said boiler to form a restriction in the downstream flue passage, said boiler nose defining a generally longitudinally extending cavity substantially between a pair of boiler side walls, a duct extending through at least one of said pair of boiler side walls and into said cavity, and a plurality of ports spaced one from the other along said nose and in communication with said duct for injecting overfire air supplied to said duct into the downstream flue gas passage; and including a second duct in said cavity and in communication with a supply of overfire air, and a plurality of ports spaced one from the other along said nose and in communication with said second duct for injecting overfire air supplied to said second duct into the downstream flue gas passage.

11. A boiler according to claim 10 wherein the first-mentioned and second ducts are supplied with overfire air from opposite ends of said nose.

* * * * *

UNITED STATES PATENT AND TRADEMARK OFFICE

CERTIFICATE OF CORRECTION

PATENT NO. : 7,004,086 B2
APPLICATION NO. : 10/868847
DATED : February 28, 2006
INVENTOR(S) : Morrison et al.

It is certified that error appears in the above-identified patent and that said Letters Patent is hereby corrected as shown below:

At column 2, line 1 change the sectional heading entitled "BACKGROUND OF THE INVENTION" to read --BRIEF DESCRIPTION OF THE INVENTION--

Signed and Sealed this

Second Day of September, 2008

JON W. DUDAS
*Director of the United States Patent and Trademark Office*